US007878468B2

(12) United States Patent
Chen et al.

(10) Patent No.: US 7,878,468 B2
(45) Date of Patent: Feb. 1, 2011

(54) SLIDE BRACKET

(75) Inventors: Ken-Ching Chen, Kaohsiung Hsien (TW); Shih-Long Huang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 12/724,823

(22) Filed: Mar. 16, 2010

(65) Prior Publication Data

US 2010/0171015 A1 Jul. 8, 2010

Related U.S. Application Data

(60) Division of application No. 11/779,003, filed on Jul. 17, 2007, now Pat. No. 7,699,279, which is a continuation-in-part of application No. 11/523,545, filed on Sep. 20, 2006, now abandoned.

(51) Int. Cl.
*A47B 96/06* (2006.01)

(52) U.S. Cl. ..... 248/220.41; 248/220.22; 312/334.4; 211/26

(58) Field of Classification Search ..... 248/222.11, 248/222.12, 220.1, 220.21, 220.22, 220.41, 248/220.43; 312/334.1, 334.4; 211/26, 175, 211/189–192
See application file for complete search history.

(56) References Cited

U.S. PATENT DOCUMENTS

| | | | | |
|---|---|---|---|---|
| 6,595,379 | B1 * | 7/2003 | Powell | 211/192 |
| 6,652,050 | B2 * | 11/2003 | Lin | 312/333 |
| 6,799,817 | B1 * | 10/2004 | Chu | 312/333 |
| 6,979,066 | B2 * | 12/2005 | Yang | 312/333 |
| 7,357,362 | B2 * | 4/2008 | Yang et al. | 248/221.11 |

* cited by examiner

*Primary Examiner*—Terrell Mckinnon
*Assistant Examiner*—Steven M Marsh
(74) *Attorney, Agent, or Firm*—Rosenberg, Klein & Lee

(57) ABSTRACT

A slide bracket includes a main body having an end plate and at least one hanging block. The end plate is provided with a locating holder and a corresponding opening. The locating holder contains a chamber containing a spring. The hanging block has a first post and a second post, and is disposed into the chamber to hold against the spring to expand in relation to the opening and the chamber so to allow the first and second posts penetrating through the opening of the end plate for securing the bracket to a support without relying upon tools.

3 Claims, 15 Drawing Sheets

SLIDE BRACKET

BACKGROUND OF THE INVENTION (a) Field of the Invention

This is a division of application Ser. 11/779,003 filed Jul. 17, 2007, now pending. The present invention relates to a slide bracket including a retractable hanging block composed of a first post and a second post made in a square or cylindrical form adaptable to be inserted corresponding mounting holes of multiple types of brackets and allow insertion for mounting therein without a tool.

(b) Description of the Prior Art

Usually a slide is adapted with a bracket to facilitate the slide to be locked to a metal support, as commonly observed in a rack-mounted computer system. The specification of the bracket mounting hole for the rack-mounted cabinet is available in a round hole design, that may be internally threaded or not, or a square design. The design of the bracket is diversified as taught in U.S. Pat. Nos. 6,659,577 B2, 6,891,727 B2 and US Patent Early Publication Nos. US 2006/0152115 A1, Taiwan Patent Nos. M281520 and M281525. However, some of the cited patents are applicable to mountings of a single specification. Current designs of a bracket requires that it can be adapted to different types of holes, be mounted without using any hand tools and allow fast mounting and removal.

SUMMARY OF THE INVENTION

The primary advantage of the present invention is to provide a slide bracket that is adaptable to different types of mounting holes, should it be a round or a square one, which can be inserted without using any hand tools by providing a hanging block having a first post and a second post.

According to a first aspect of the present invention, there is provided a slide bracket comprising:

a main body having an end plate provided with a locating holder and a corresponding opening, the locating holder containing a chamber;

a hanging block having a first post and a second post, and being disposed in the chamber and being extendable to move in relation to the opening and the chamber; and a retaining member being pivotally connected to the main body and having a locking end facing in the direction of the end plate.

Preferably, a spring is disposed in the chamber of the locating holder to function against the hanging block, and a flange is disposed to the first post of the hanging block.

Preferably, an axial hole is disposed in the first post of the hanging block for insertion of the second post; a restraining ring is disposed inside the axial hole to fit onto the second post; an inner end of the second post is connected to the locating holder; a first spring and a second spring are disposed in the chamber with the first spring functioning against the first post and the second spring functioning against the restraining ring.

Preferably, a gradation part is disposed on the second post in relation to an inner circumference of the restraining ring; two tapered surfaces corresponding to each other are respectively provided on the axial hole and the restraining ring; and the restraining ring is provided with axial slots.

Preferably, the first post of the hanging block is disposed with an axial hole for insertion of the second post; an inner end of the second post is connected to the locating holder; the chamber contains a spring; the spring functions against the first post; and the first post is disposed with a flange to hold against the opening of the end plate.

Preferably, the main body is formed with a pair of pivoting tags in relation to the retaining member, and a pin is provided to connect the pair of pivoting tags.

Preferably, a resilient member functioning against the retaining member is a resilient plate having a clamping part at one end to clamp on the retaining member and a locating part at another end to hold against the main body; or alternatively, the resilient member is a torsion spring having a force-applying end holding against the retaining member and a locking end holding against the main body.

According to a second aspect of the present invention, there is provided a slide bracket having a hanging block structure comprising:

a main body having an end plate provided with a locating holder and a corresponding opening, the locating holder containing a chamber, a spring being disposed in the chamber; and a hanging block having a first post and a second post, and being disposed in the chamber to hold against the spring to extend for movement in relation to the opening and the chamber, both the first post and the second post penetrating through the opening of the end plate.

According to a third aspect of the present invention, there is provided a slide bracket having a hanging block structure comprising:

a main body having an end plate provided with a locating holder and a corresponding opening, the locating holder containing a chamber, the chamber containing a first spring and a second spring; and a hanging block having a first post and a second post, and being disposed in the chamber, the first post being disposed with an axial hole for insertion of the second post, a restraining ring being provided in the axial hole to fit onto the second post, an inner end of the second post being connected to the locating holder, the first post holding against the first spring and the restraining ring holding against the second spring.

According to a fourth aspect of the present invention, there is provided a slide bracket comprising:

a main body having an end plate provided with a locating holder and a corresponding opening, the locating holder containing a chamber; and a hanging block having a first post and a second post, and being disposed in the chamber and being extendable to move in relation to the opening and the chamber, the first post of the hanging block being disposed with an axial hole for insertion of the second post, an inner end of the second post being connected to the locating holder, the chamber containing a spring, the spring functioning against the first post, the first post being disposed with a flange to hold against the opening of the end plate.

Preferably, the form of the first post is different from that of the second post. Furthermore, the first post may be made in a square form and the second post may be made in a cylindrical form. However, the first post may be also made in a cylindrical form.

By referring to the prior art, the present invention provides the following benefits and advantages:

a. allowing fast mounting and dismounting;
b. adaptable to supports with square or round mounting holes;
c. providing ingeniously designed hanging block without compromising its universal purpose.

DETAILED DESCRIPTION OF THE PREFERRED EMBODIMENTS

Figure 1:
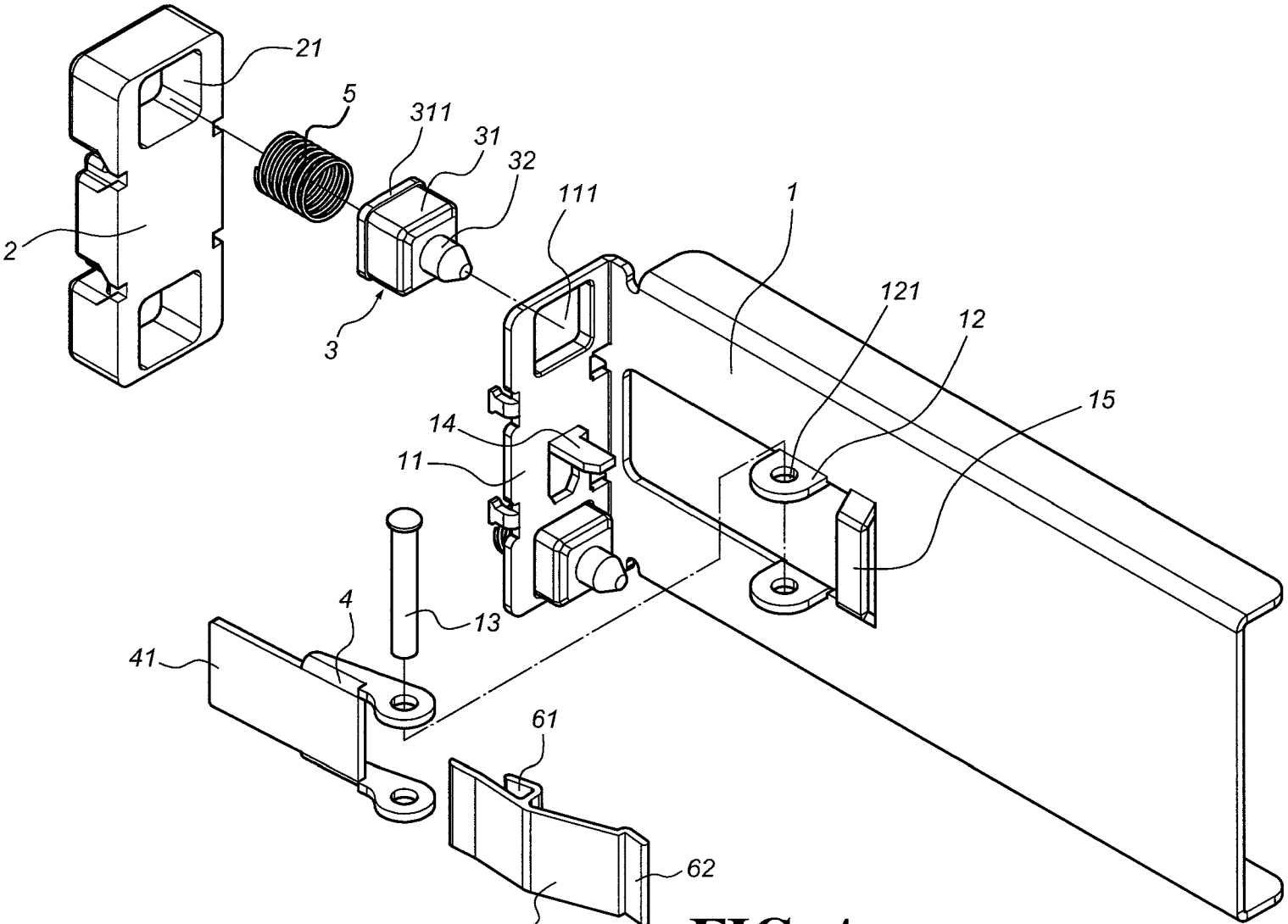
FIG. 1 is an exploded view of a first embodiment of the present invention.
Figure 2:
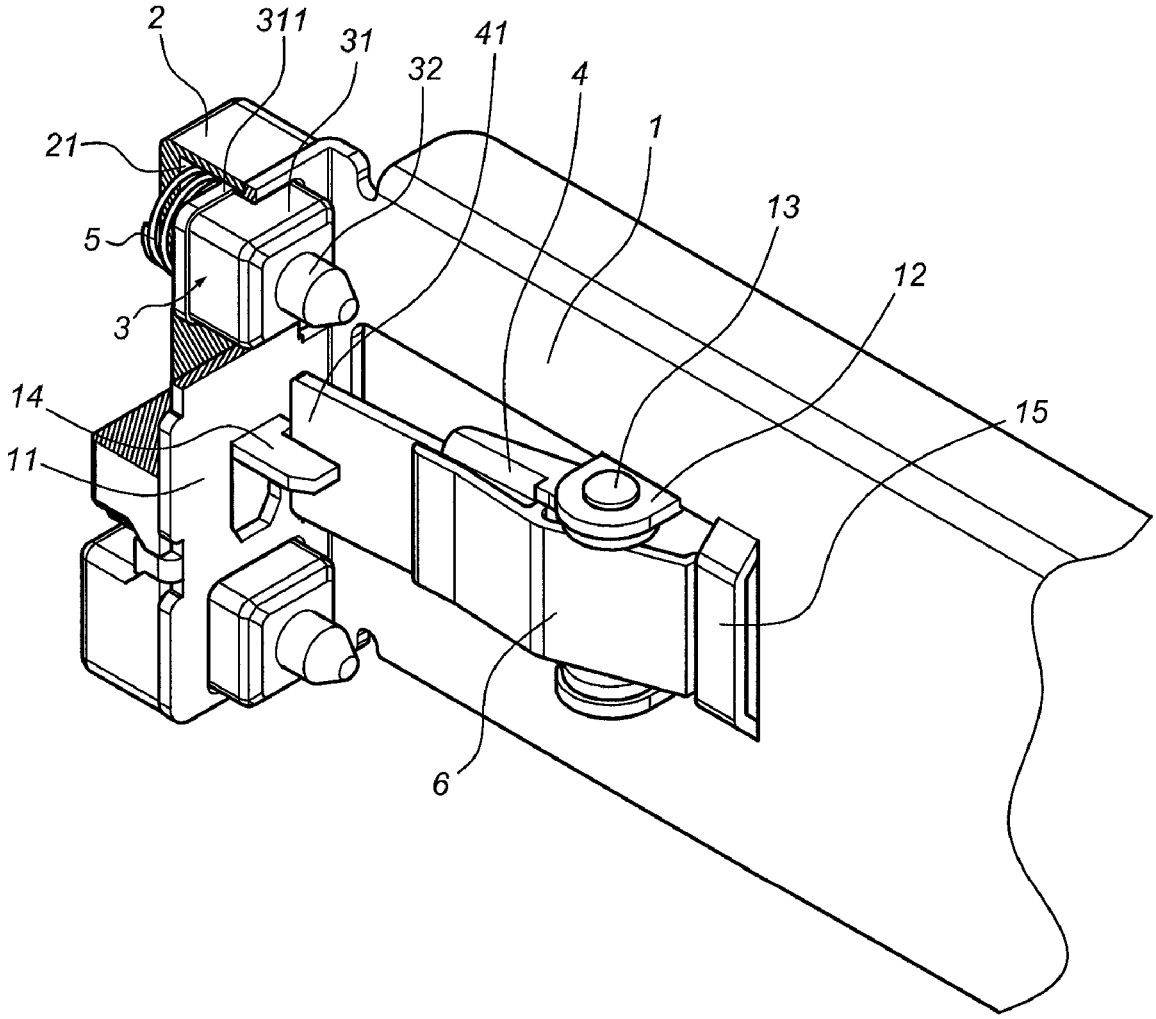
FIG. 2 is a schematic view showing the first embodiment of the present invention as assembled.

Referring to FIGS. 1 and 2, a first preferred embodiment of a slide bracket of the present invention includes a main body (1), a locating holder (2), a hanging block (3), a retaining member (4), a spring (5), and a resilient member (6).

The main body (1) is provided with an end plate (11) and an opening (111) is provided on the end plate (11). One or a plurality of opening (111) may be disposed on the end plate (11) depending on the mounting of the main body (1). As illustrated, two openings (111) are provided on the main body (1). A pair of pivoting tags (12), each provided with an axial hole (121), is disposed on the main body (1) and a pin (13) is disposed to penetrate through the pair of pivoting tags (12). A limiting member (14) is disposed on the back of the end plate (11) and a retaining plate (15) is disposed near the pair of pivoting tags (12).

The locating holder (2) is connected to the front of the end plate (11) of the main body (1) and contains two chambers (21) corresponding to the number of the opening (111) as illustrated.

The hanging block (3) includes a first post (31) and a second post (32) connected to each other. The first post (31) is made in the form of square (or cylindrical, but not illustrated). The second post (32) is made in a cylindrical form. The first post (31) of the hanging block (3) penetrates through the opening (111) of the main body (1) into the chamber (21) of the locating holder (2) for the hanging block (3) to expand for movement. The spring (5) is inserted into the chamber (21) to function against the first post (31) of the hanging block (3) for it to provide a return force. A flange (311) is disposed on the first post (31) to hold against the opening (111) of the main body (1).

The retaining member (4) is pivotally connected to the pivoting tags (12) of the main body (1), and has a locking end (41) facing the back of the end plate (11) of the main body (1). The retaining member (4) is provided with the resilient member (6) which is a resilient plate having a clamping part (61) at one end to clamp on the retaining member (4) and a locating part (62) at the other end to hold against the retaining plate (15) disposed on the main body (1) to provide return elasticity to the retaining member (4).

Figure 3:
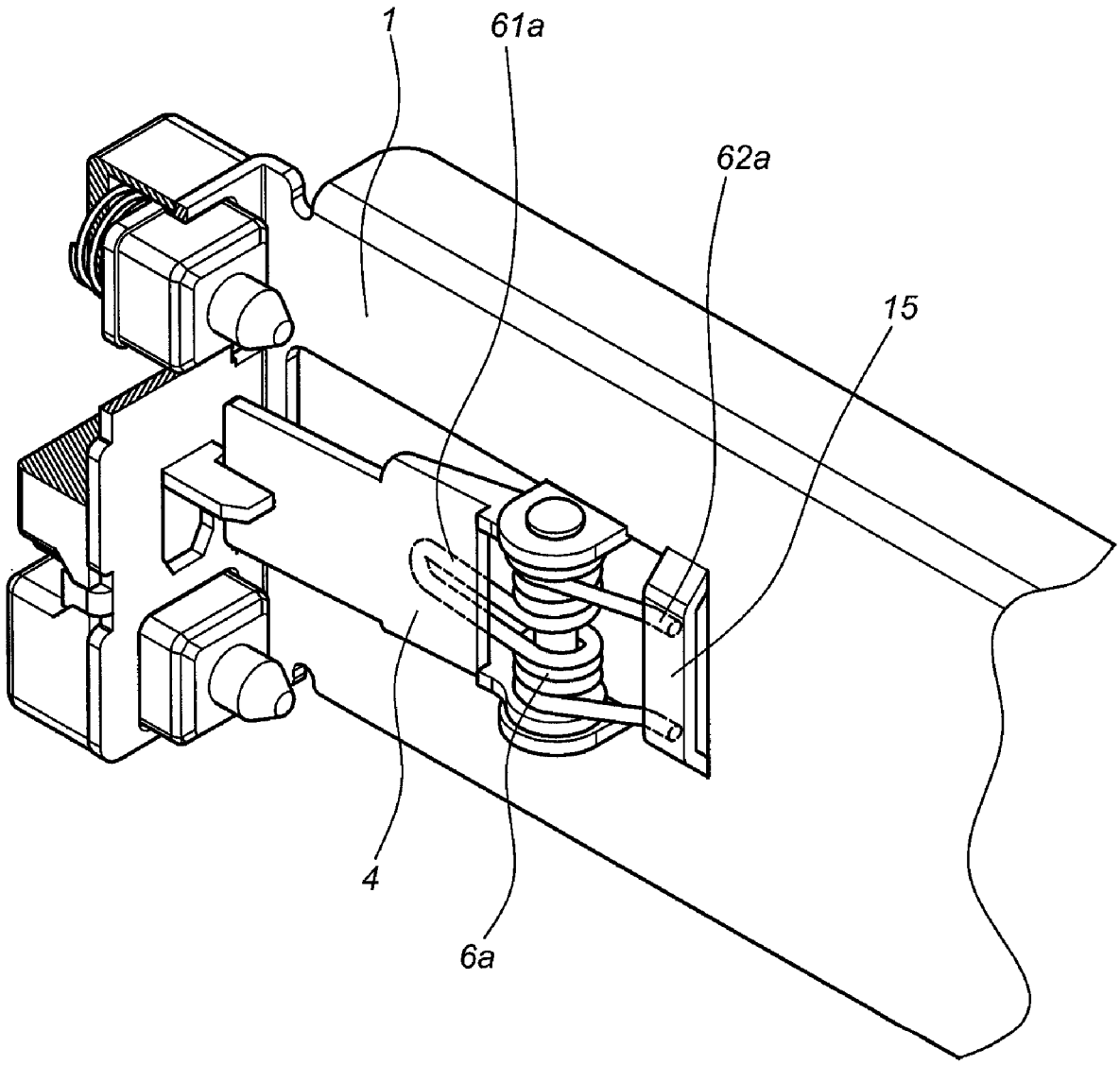
FIG. 3 is a schematic view showing that a resilient member in the first embodiment of the present invention is a torsion spring to function on a retaining member.

The means for applying a return elasticity to the retaining member (4) is not limited to that as described above. As illustrated in FIG. 3, a resilient member (6*a*) is a torsion spring containing a force-applying end (61*a*) to hold against the retaining member (4) and a locating end (62*a*) to hold against the retaining plate (15) on the main body (1).

Figure 4:
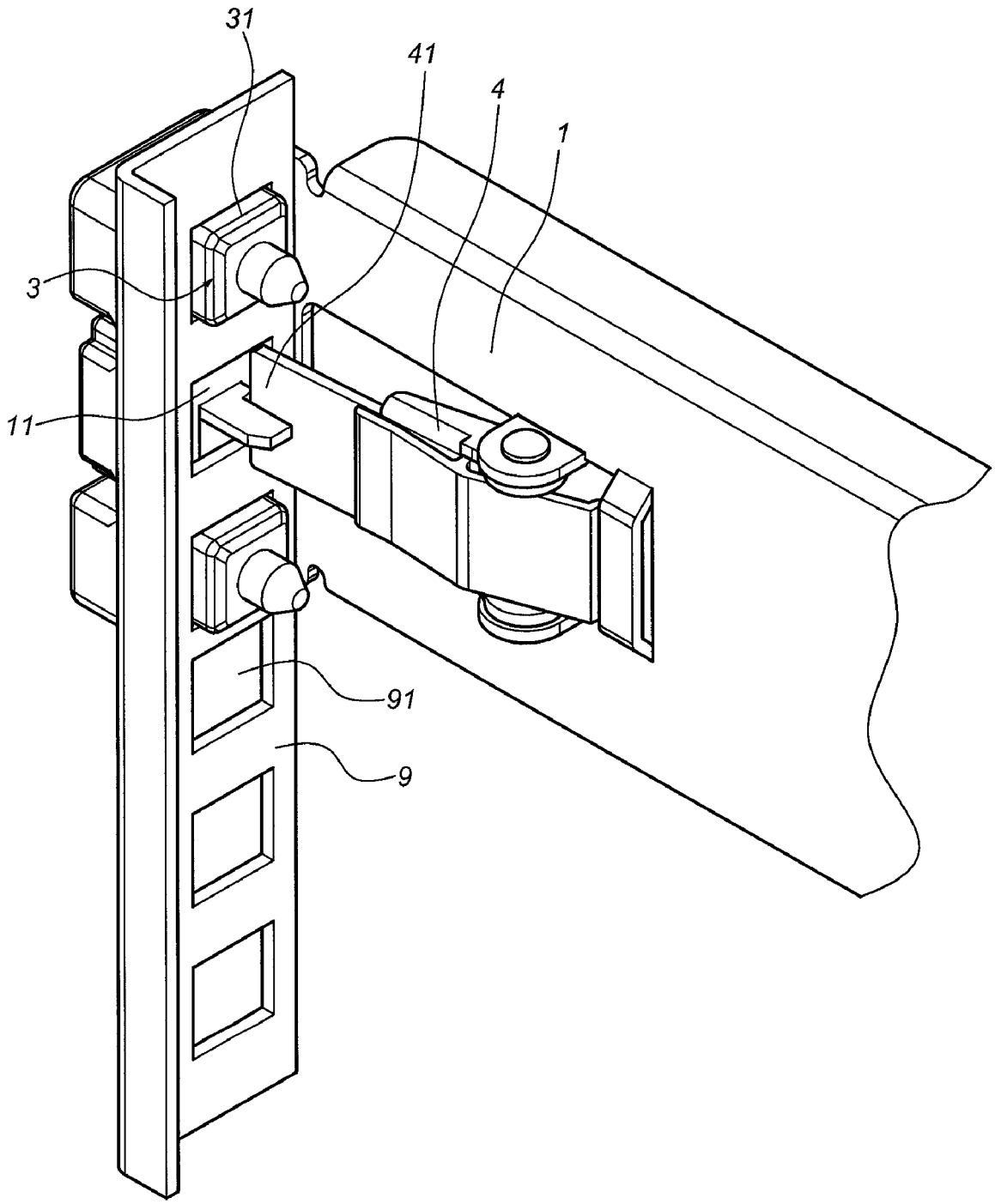
FIG. 4 is a schematic view showing the first embodiment of the present invention adapted to a support provided with square mounting holes.
Figure 5:
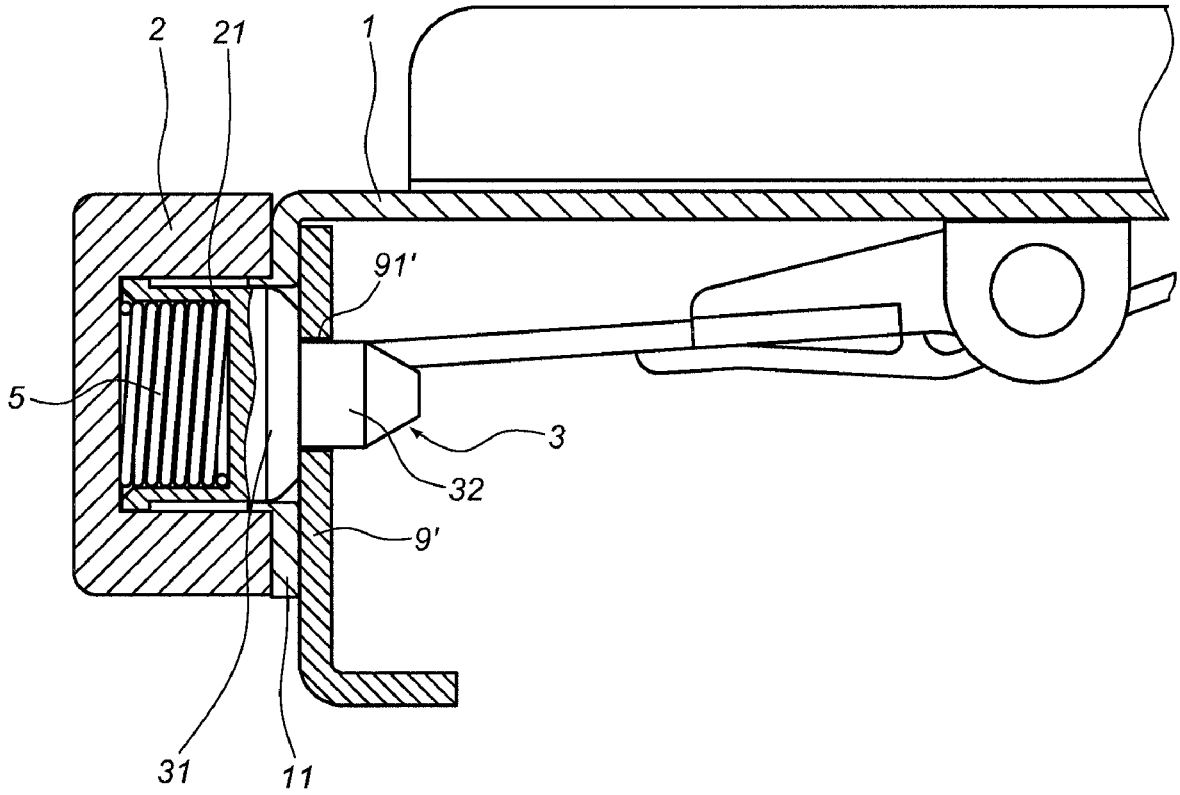
FIG. 5 is a sectional view showing the first embodiment of the present invention adapted to a support provided with round mounting holes.
Figure 6:
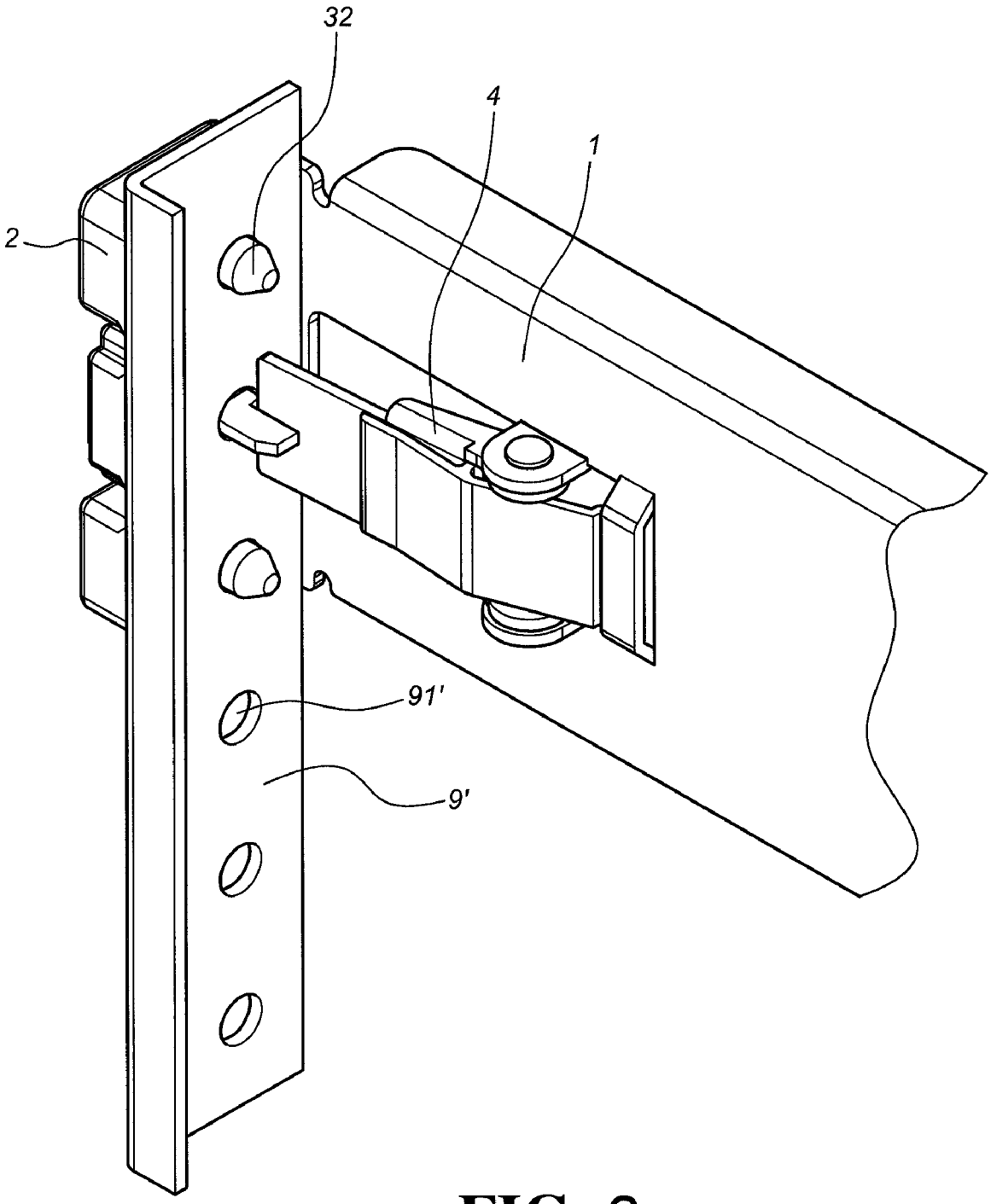
FIG. 6 is a schematic view showing the first embodiment of the present invention adapted to a support provided with round mounting holes.

Now referring to FIG. 4, in order to mount the bracket to a support (9) provided with multiple of mounting holes (91), each made in a square form, the first post (31) of the hanging block (3) is inserted into the mounting hole (91) of the support (9) with the locking end (41) of the retaining member (4) holding against the support (9) while having the retaining member (4) and the end plate (11) of the main body (1) holding and securing the support (9). When adapted to a support (9') provided with multiple round mounting holes (91') as illustrated in FIGS. 5 and 6, the main body (1) has the second post (32) of the hanging block (3) inserted into the round mounting hole (91') of the support (9') with the first post (31) of the hanging block (3) to automatically retract in the chamber (21) of the locating holder (2) and to compress against the spring (5) disposed in the chamber (21).

Figure 7:
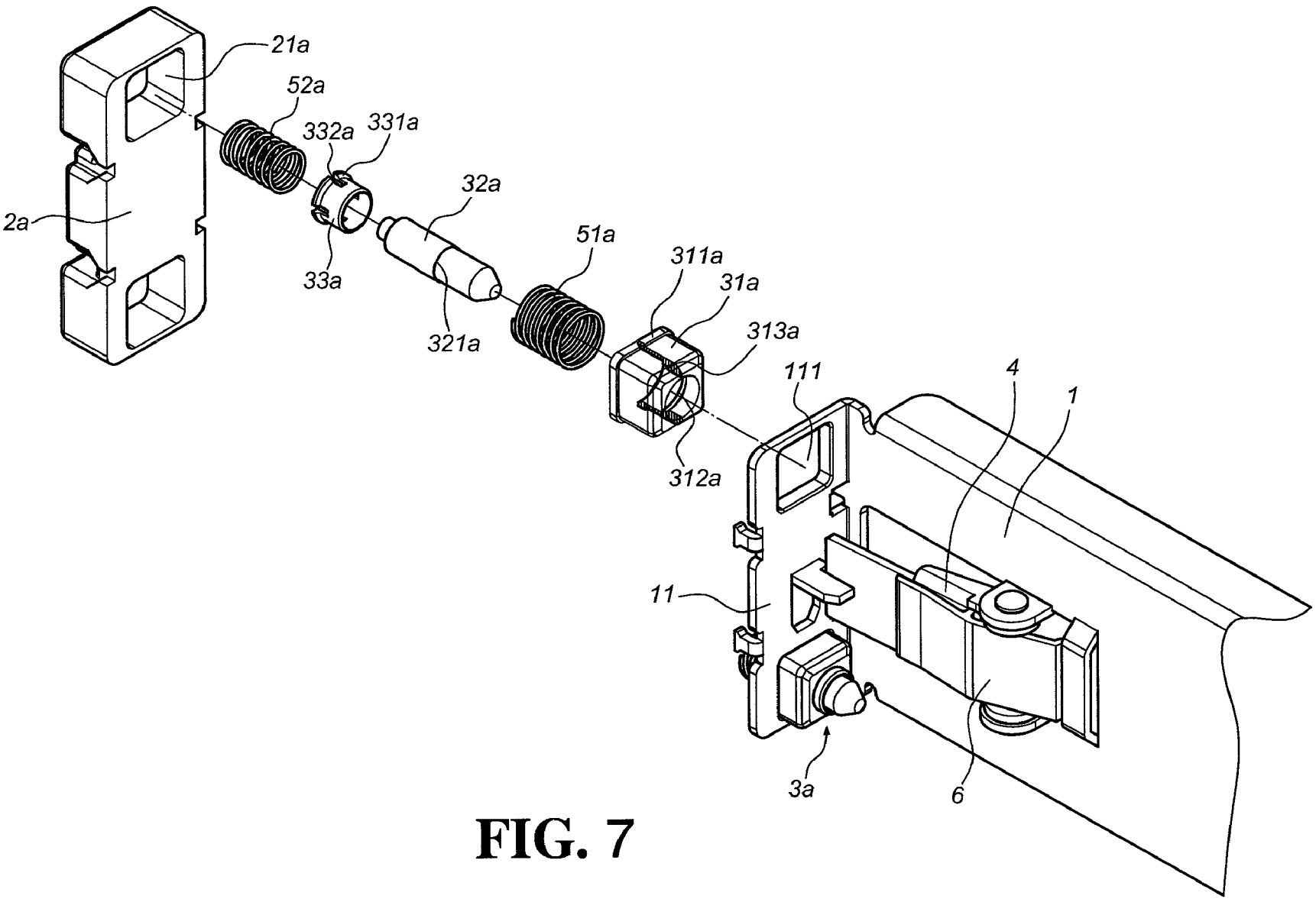
FIG. 7 is an exploded view of a second embodiment of the present invention.
Figure 8:
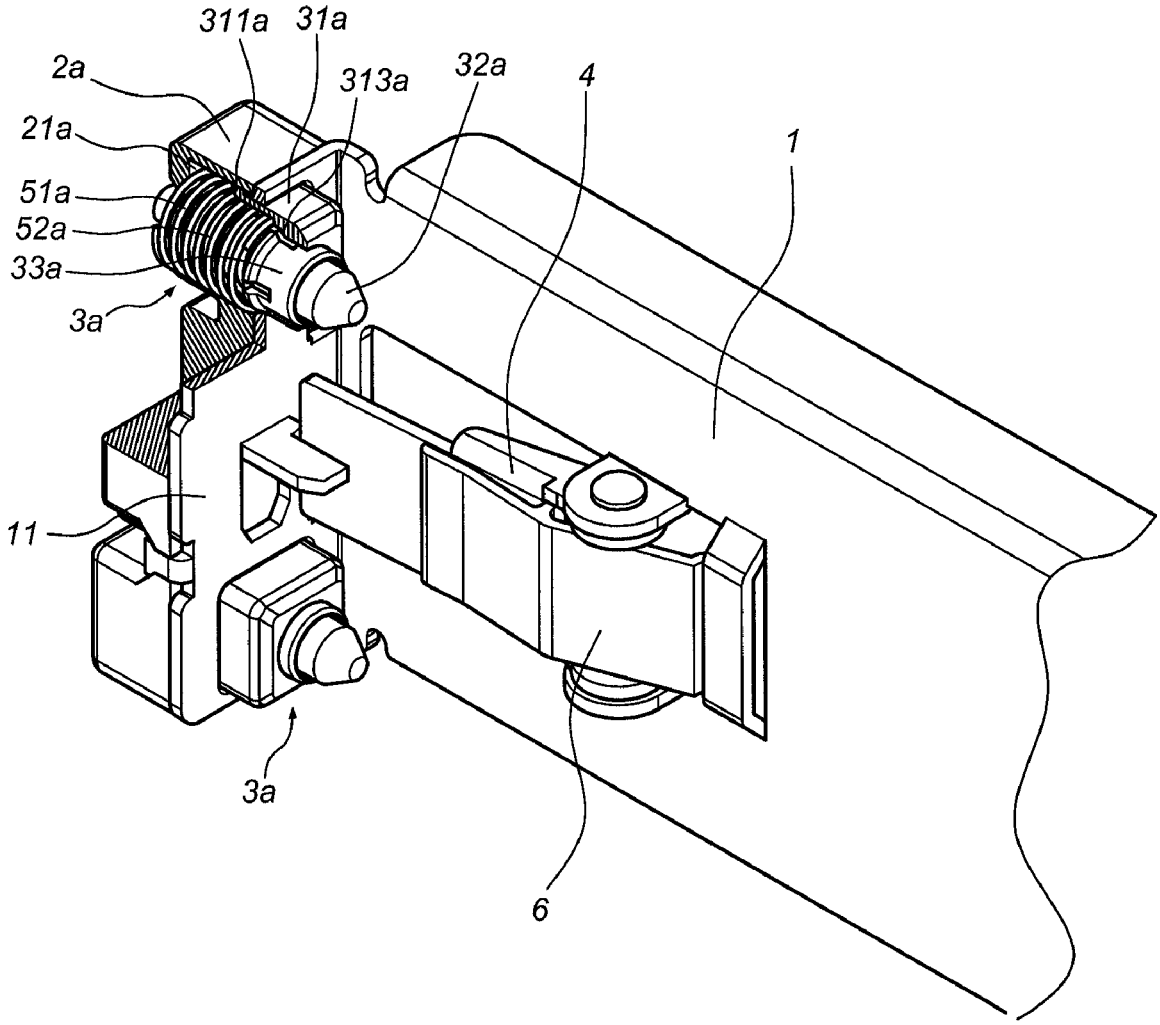
FIG. 8 is a schematic view showing the second embodiment of the present invention as assembled.

In a second preferred embodiment of the present invention as illustrated in FIGS. 7 and 8, a first post (31*a*) and a second post (32*a*) of a hanging block (3*a*) are designed such that both posts to be inserted into each other. The first post (31*a*) is disposed with an axial hole (312*a*) for the first post (31*a*) to receive insertion of the second post (32*a*). Meanwhile, the second post (32*a*) has its inner end to be connected to a locating holder (2*a*). A restraining ring (33*a*) is disposed in the axial hole (312*a*) of the first post (31*a*) in order to be inserted onto the second post (32*a*). A chamber (21*a*) of the locating holder (2*a*) contains a first spring (51*a*) and a second spring (52*a*) with the former functioning on the first post (31*a*) and the latter functioning on the restraining ring (33*a*). The first post (31*a*) is provided with a flange (311*a*) to hold against the opening (111) of the main body (1). A gradation part (321*a*) is disposed on the second post (32) to relatively hold against the inner perimeter of the restraining ring (33*a*). Two tapered surfaces (313*a*, 331*a*) are respectively disposed on the axial hole (312*a*) and the restraining ring (33*a*), and the circumference of the restraining ring (33*a*) is provided with axial slots (332*a*).

Figure 9:
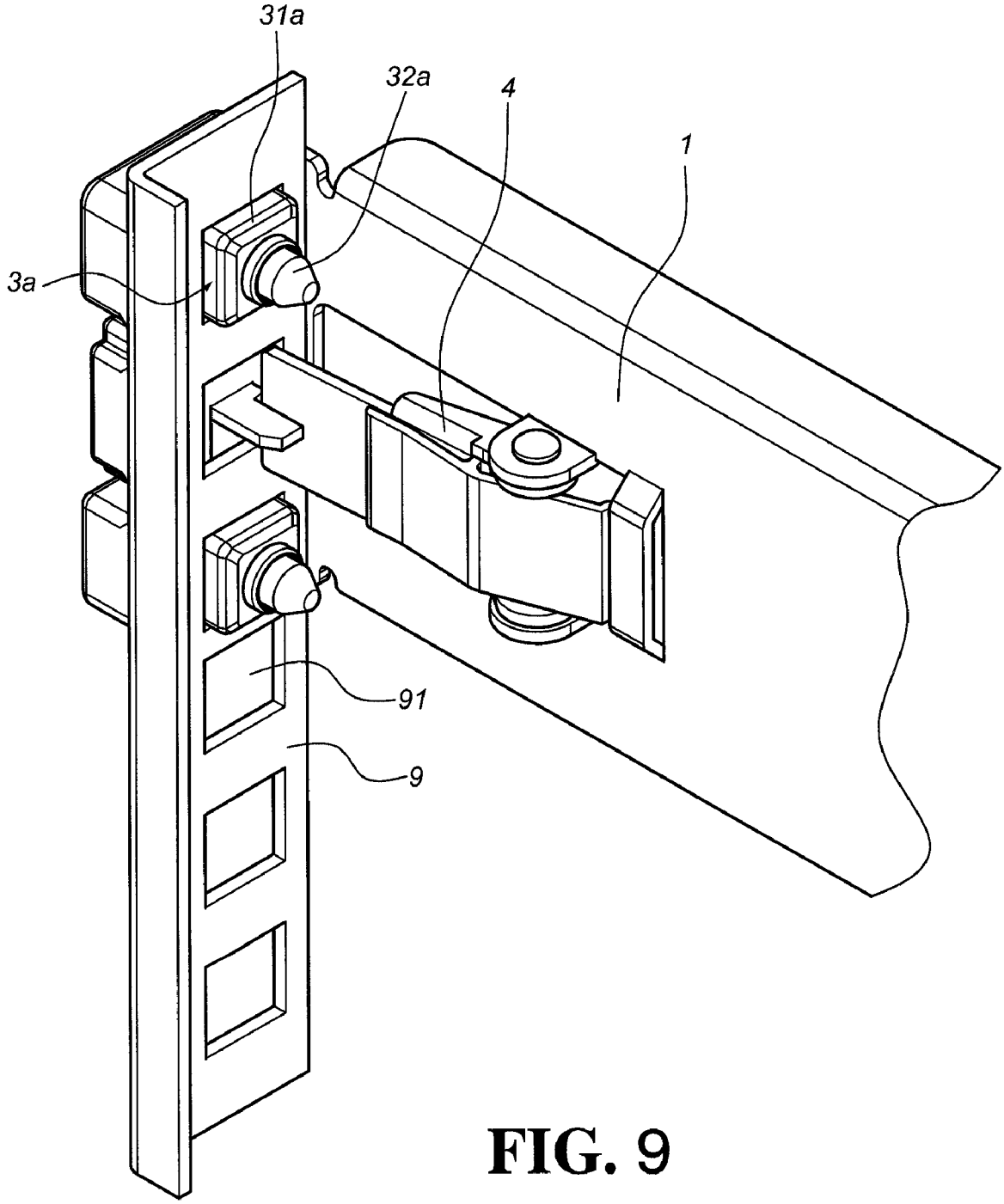
FIG. 9 is a schematic view showing the second embodiment of the present invention adapted to a support provided with square mounting holes.
Figure 10:
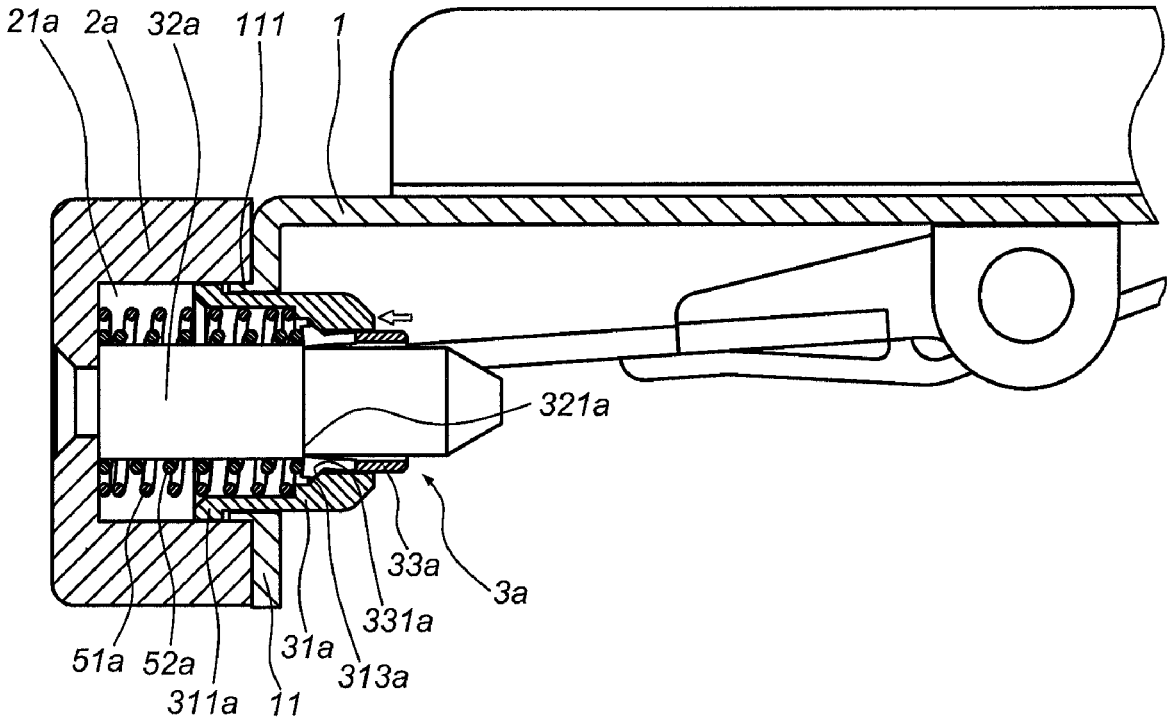
FIG. 10 is a schematic view showing the prevention of a first post from being retracted inward in the second embodiment of the present invention.

As illustrated in FIG. 9, when adapted to the support (9) provided with multiple mounting holes (91), each made in a square form, the main body (1) has the first post (31*a*) of the hanging block (3*a*) inserted into the mounting hole (91) of the support (9) and the retaining member (4) holding against the support (9). To prevent the first post (31*a*) from being automatically retracted too easily so as to facilitate insertion into the mounting hole (91) of the support (9), when the first post (31*a*) is pushed against alone, as illustrated in FIG. 10, the tapered surface (313*a*) of the first post (31*a*) will compress the tapered surface (331*a*) of the restraining ring (33*a*). Because the second spring (52*a*) is holding against the restraining ring (33*a*), the restraining ring (33*a*) provided with the slots (332*a*) is forced to retract inward when pushed by the tapered surface (313*a*) of the first post (31*a*); and the retaining ring (33*a*) in turn holds against the gradation part (321*a*) of the second post (32*a*) to restrict the first post (31*a*).

Figure 11:
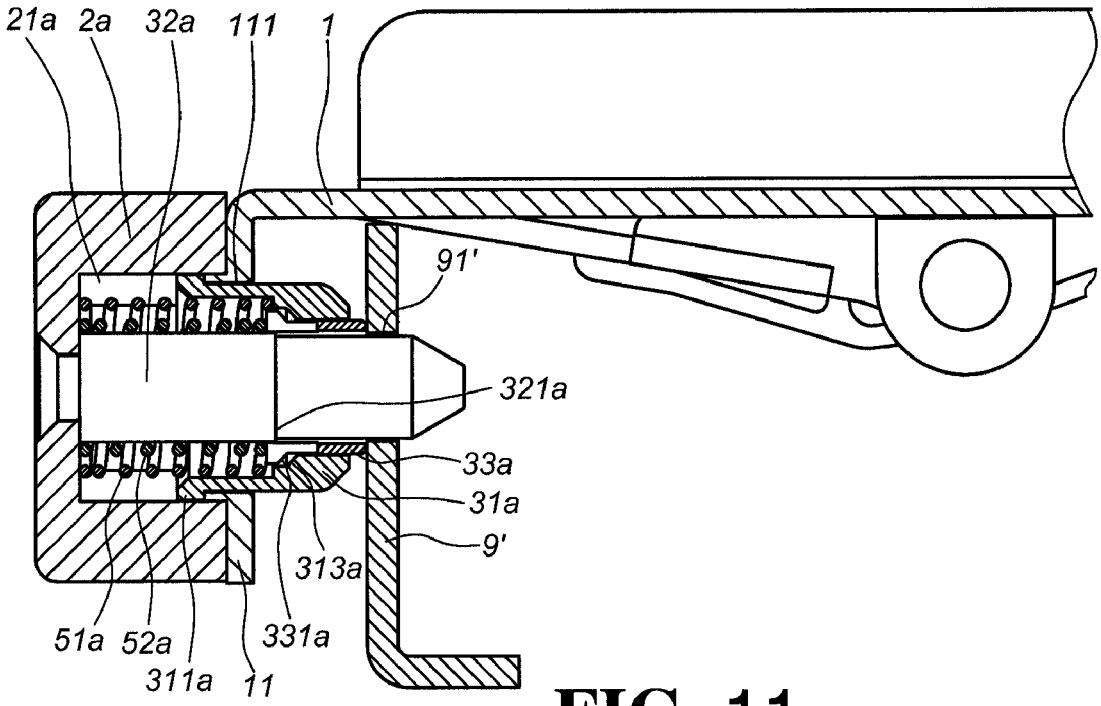
FIG. 11 is a schematic view showing a first stage of the second embodiment of the present invention adapted to a support provided with round mounting holes by having the front section of a second post inserted into the round mounting hole.
Figure 12:
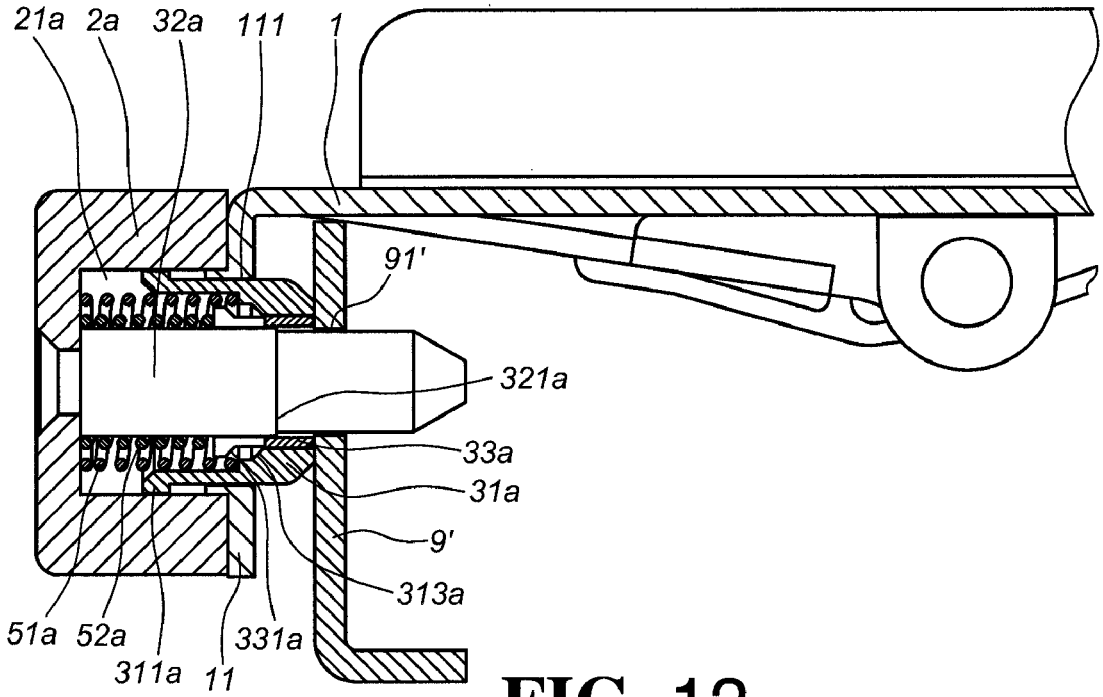
FIG. 12 is a schematic view showing a second stage of the second embodiment of the present invention adapted to a support provided with round mounting holes by having the restraining ring being pushed to retract inward.
Figure 13:
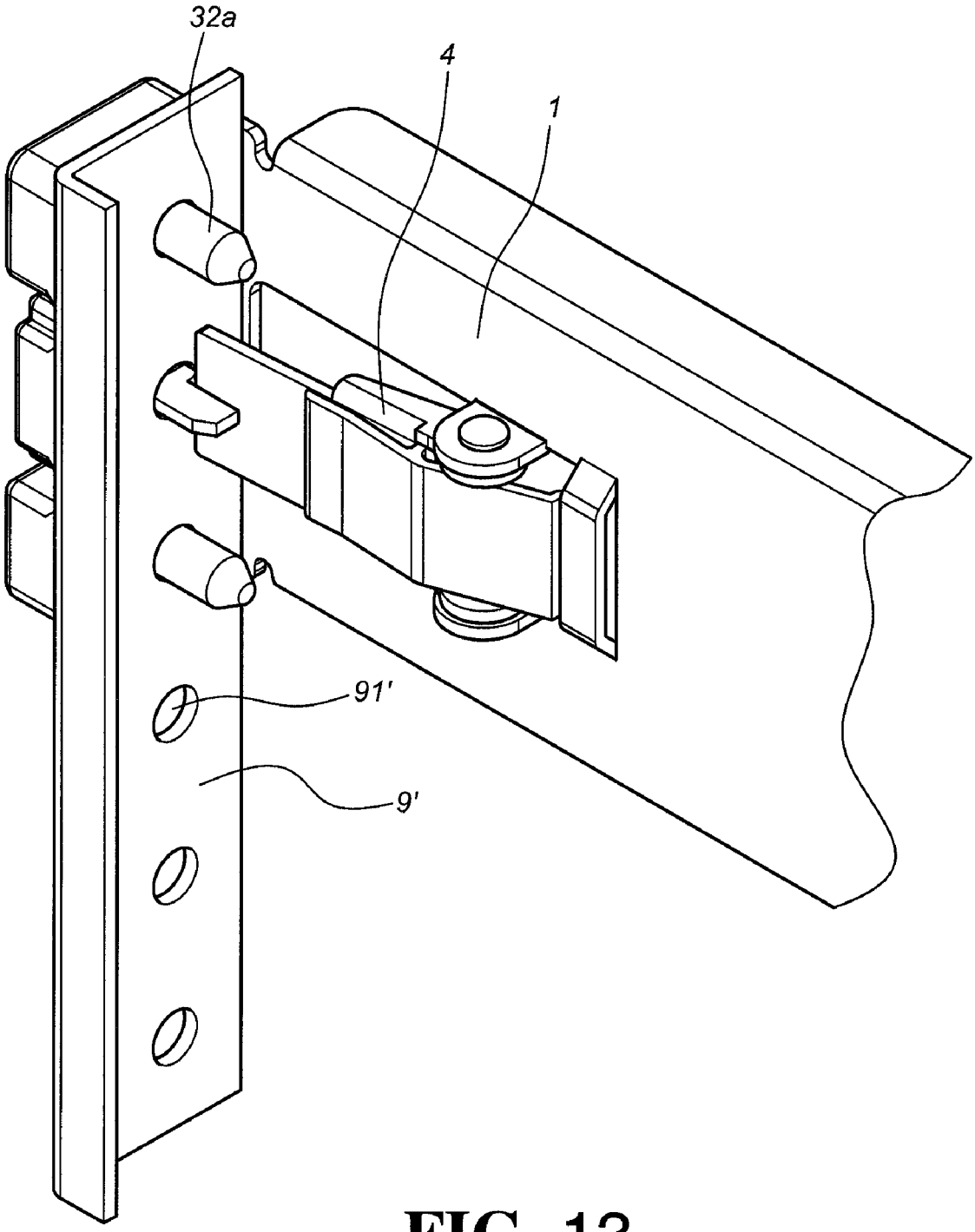
FIG. 13 is a schematic view showing the completion of the second embodiment of the present invention adapted to a support with the first post being retracted inward and the second post being fully inserted into the round mounting hole.

When adapted to the support (9') provided with multiple mounting holes (91') with each made in a round form as illustrated in FIG. 11, the main body (1) has the front section of the second post (32*a*) of the hanging block (3*a*) inserted into the mounting hole (91') of the support (9'). As the hanging block (3*a*) is pushed in further towards the support (9') as illustrated in FIG. 12, the restraining ring (33*a*) is first pushed and retracted to allow its end provided with the axial slots (332*a*) to penetrate through the gradation part (321*a*) of the second post (32*a*) and further into the hanging block (3*a*). As illustrated in FIG. 13, the first post (31*a*) of the hanging block (3*a*) is also pushed to retract by the support (9') to allow the second post (32*a*) to be pushed even further into the mounting hole (91') of the support (9') while the retaining member (4) is also holding against the support (9').

Figure 14:
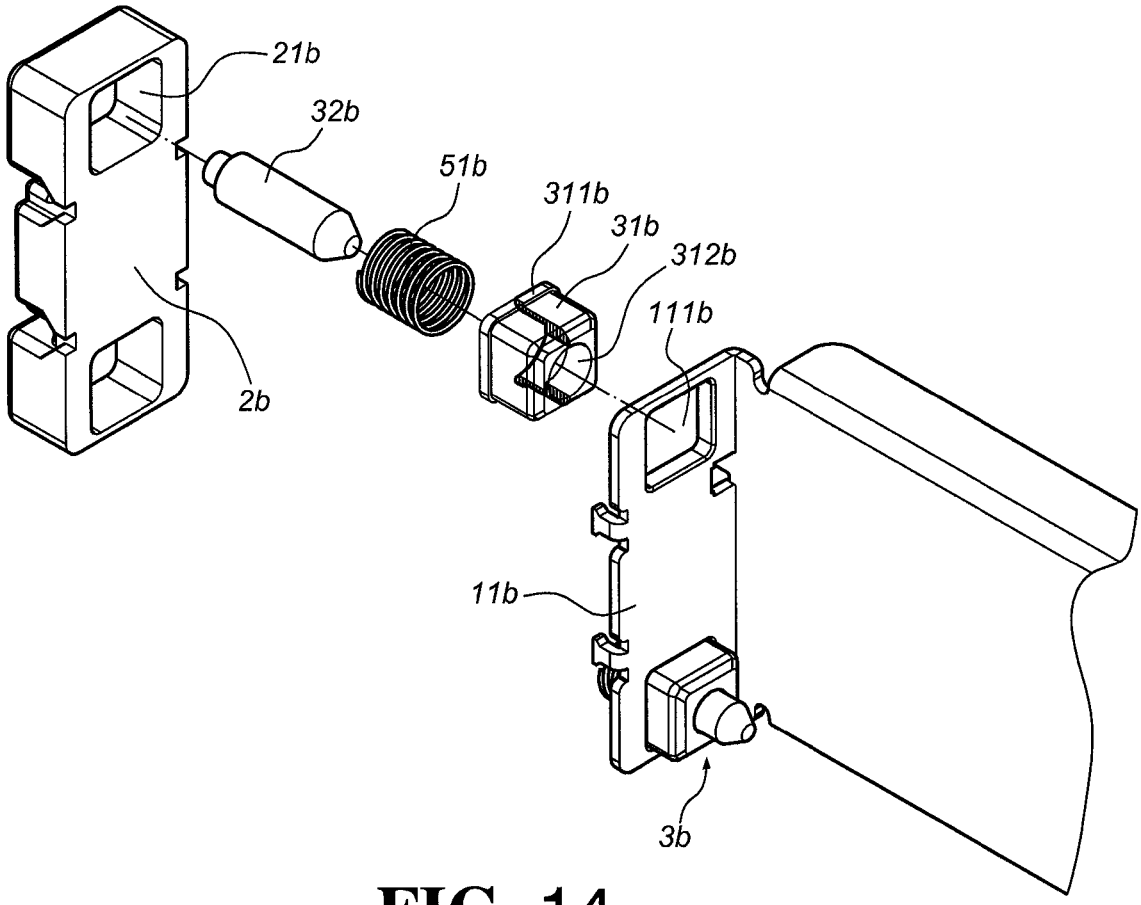
FIG. 14 is an exploded view of a third embodiment of the present invention.
Figure 15:
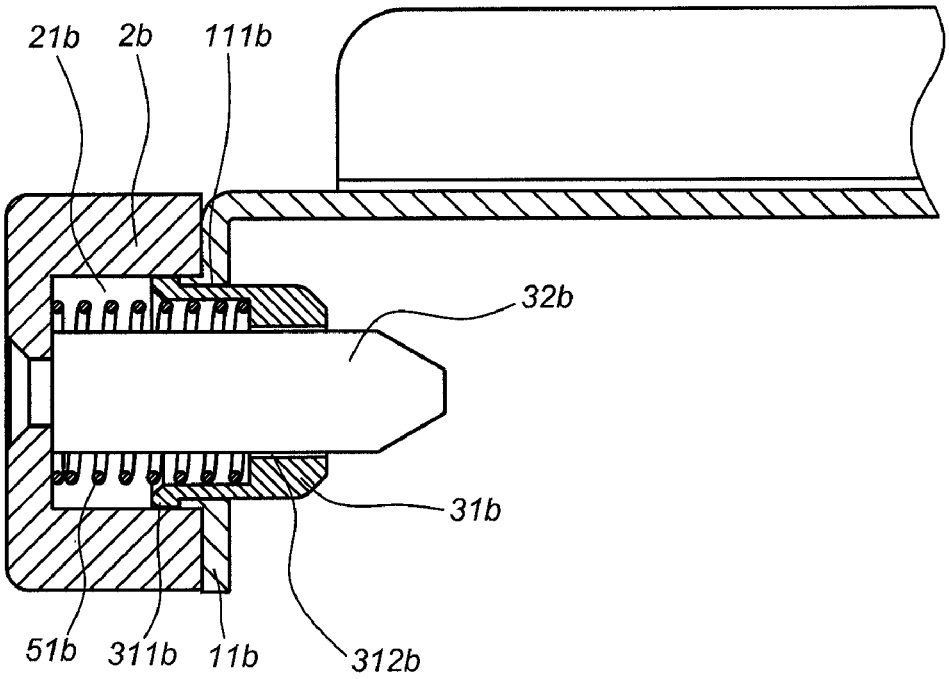
FIG. 15 is a schematic view showing the third embodiment of the present invention as assembled.

In a third embodiment of the present invention as illustrated in FIGS. 14 and 15, a hanging block (3*b*) comprises a first post (31*b*) and a second post (32*b*). The second post (32*b*) is made in a cylindrical form. The first post (31*b*) is disposed with an axial hole (312*b*) for insertion of the second post (32*b*). The second post (32*b*) has its inner end to be connected to a locating holder (2*b*). A chamber (21*b*) of the locating holder (2*b*) contains a spring (51*b*) functioning on the first post (31*b*). The first post (31*b*) is provided with a flange (311*b*) to hold against an opening (111*b*) of an end plate (11*b*).

Figure 16:
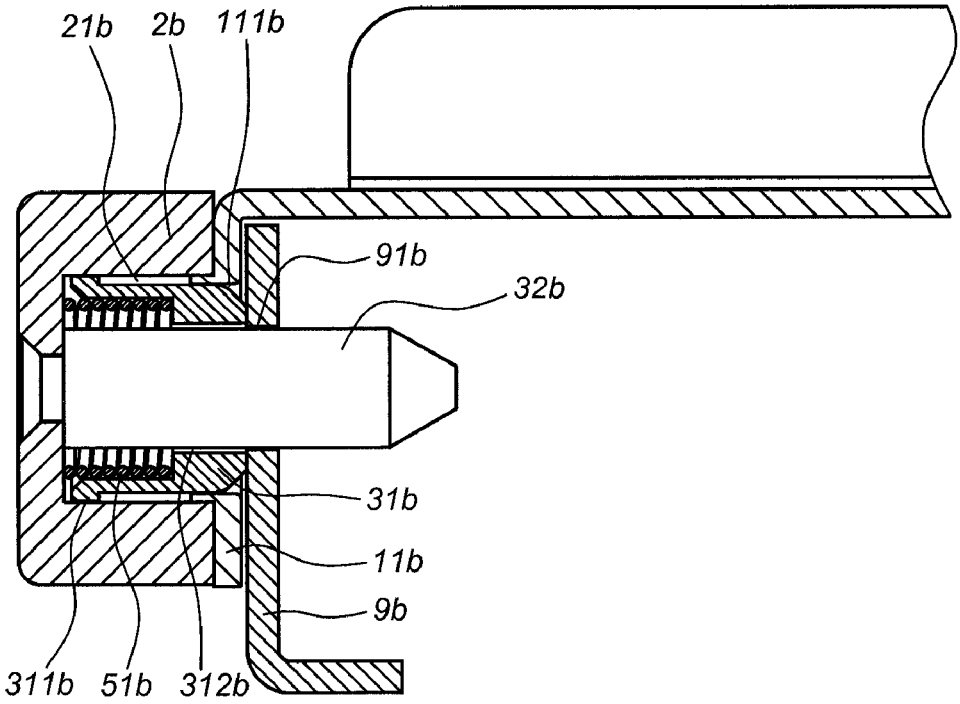
FIG. 16 is a schematic view showing the third embodiment of the present invention adapted to a support provided with round mounting holes.

When adapted to the support (9*b'*) provided with multiple mounting holes (91*b'*) with each made in a round form as illustrated in FIG. 16, the second post (32*b*) of the hanging block (3*b*) is inserted into the mounting hole (91*b'*) of the support (9*b'*). As the hanging block (3*b*) is pushed in further towards the support (9*b'*), the first post (31*b*) of the hanging block (3*b*) is also pushed to retract by the support (9*b'*) to allow the second post (32*b*) to be pushed even further into the mounting hole (91*b'*) of the support (9'*b*) and the spring (51*b*) to be compressed.

Figure 17:
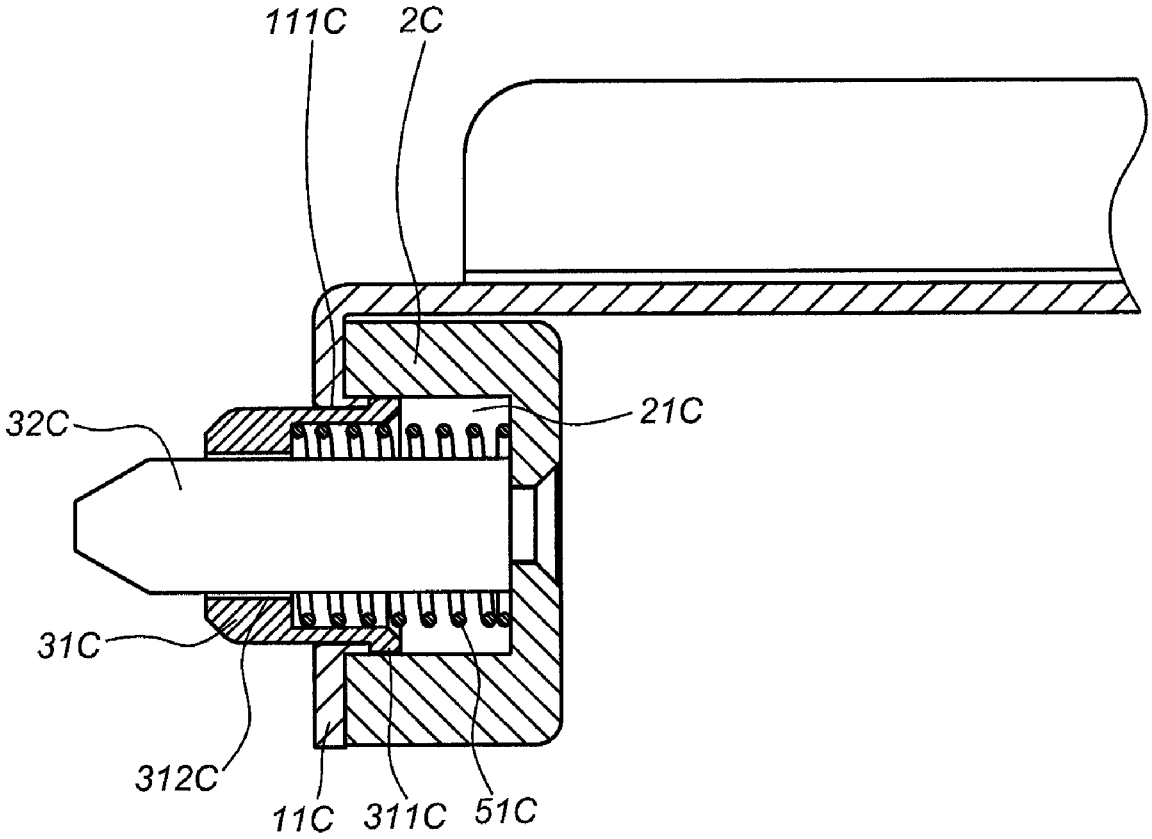
FIG. 17 is cross-sectional view of a fourth embodiment of the present invention.

A fourth embodiment of the present invention as shown in FIG. 17, comprises a locating holder (2*c*) and a hanging block (3*c*) which are in different directions compared to the above embodiments. The hanging block (3*c*) comprises a first post (31*c*) and a second post (32*c*). The second post (32*c*) is made in a cylindrical form. The first post (31*c*) is disposed with an axial hole (312*c*) for insertion of the second post (32*c*). The second post (32*c*) has its inner end to be connected to the locating holder (2*c*). A chamber (21*c*) of the locating holder (2*c*) contains a spring (51*c*) functioning on the first post (31*c*). The first post (31*c*) is provided with a flange (311*c*) to hold against an opening (111*c*) of an end plate (11*c*).

What is claimed is:

1. A slide bracket having a hanging block structure, comprising:

a main body having an end plate provided with a locating holder and a corresponding opening, the locating holder containing a chamber;

a spring being disposed in the chamber; and a hanging block having a first post and a second post, and being disposed in the chamber to hold against the spring to extend for movement in relation to the opening and the chamber, both the first post and the second post penetrating through the opening of the end plate;

wherein the first post of the hanging block is disposed with a flange to hold against the opening of the end plate.

2. The slide bracket having a hanging block structure as claimed in claim 1, wherein the first post of the hanging block is disposed with an axial hole for insertion of the second post, and an inner end of the second post being connected to the locating holder.

3. The slide bracket having a hanging block structure as claimed in claim 1, wherein the first post and the second post connected to each other.

* * * * *